US006767261B1

(12) United States Patent
Woodall et al.

(10) Patent No.: US 6,767,261 B1
(45) Date of Patent: Jul. 27, 2004

(54) THREE-DIMENSIONAL VORTEX WAKE CANCELLING JET PROPULSION METHOD

(75) Inventors: Robert Woodall, Panama City Beach, FL (US); Felipe Garcia, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/457,693

(22) Filed: May 19, 2003

(51) Int. Cl.[7] ..... B63H 11/103
(52) U.S. Cl. ..... 440/47; 440/38
(58) Field of Search ..... 440/38, 47

(56) References Cited

U.S. PATENT DOCUMENTS 6,213,431 B1 * 4/2001 Janeke ..... 244/172
6,648,275 B2 * 11/2003 Janeke ..... 244/172
2002/0148069 A1 * 10/2002 Illingworth ..... 15/346

* cited by examiner

*Primary Examiner*—Jesus D. Sotelo
(74) *Attorney, Agent, or Firm*—Donald G. Peck; Harvey A. Gilbert

(57) ABSTRACT

An underwater propulsion system and method are more efficient and reduce vortex wake effects. A submersible has a cylindrically-shaped hull, a nose portion connected forward and a sinusoidal-shaped tapered portion aft coaxially symmetrically disposed around a longitudinally extending axis. The tapered portion has a leading end the same diameter as the hull, a symmetrical apex at its trailing end on the longitudinal axis, and symmetrical rounded laterally extending contours and rounded longitudinally extending contours. An internal pump creates volumes of pressurized water from ambient water for equal-distantly-spaced-apart jets extend through the tapered portion in a circumferential row extending around the tapered portion. The jets point in an asymptotical relationship with respect to a down slope surface of the tapered portion and emit jetted water that creates a spinning toroidal vortex of swirling jetted water along the down slope of the tapered portion.

52 Claims, 4 Drawing Sheets

THREE-DIMENSIONAL VORTEX WAKE CANCELLING JET PROPULSION METHOD

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to an apparatus and method for propelling a submersible through water. More particularly, this invention is to an apparatus and method for efficiently propelling a submerged craft that virtually eliminates wake drag effects.

Marine engineers continue to create designs that more efficiently propel objects and vehicles through the water, particularly as fuel costs rise. These propulsion systems should also produce the smallest residual environmental effects since large wakes produce undesirable far-reaching consequences on shoreline structures and marine habitat.

From a tactical standpoint, another important design consideration is the reduction of detectability of a propulsion system and its support vessel by an adversary. Previous marine propulsion methods make use of propellers, ducted propellers, impellers, and vectored jets of water. Propellers produce large amounts of in-water noise and are also fairly inefficient in propelling an object through the water. As the propeller blades move transiationally through the water, they expose the surface area of the propeller to the water flow external to the vessel's hull and create unwanted drag. Contemporary water-jet systems and impellers produce jets of water behind the craft for forward thrust that can be vectored for steering. However, these jets are inefficient and generate great amounts of noisy scatter-turbulence rearward of the moving craft.

Thus, in accordance with this inventive concept, a need has been recognized in the state of the art for an underwater propulsion system using multiple concentrically located jets of water that are pointed to flow coaxially and asymptotically along the surface of a hull of tapering elliptic, hyperbolic, or parabolic curvature (with K (p)>0, K (p)<0, and K (p)=0 (but S(p) ‡0), respectively) or similarly tapering curved hull that approaches a parallel flat plane (with K(p)=0, S(p)=0) at its end where the jets of water roll off the hull to induce efficient vortex wake effects, over the hull and past the hull, that optimize flow efficiency of a submerged craft being propelled through the water.

OBJECTS AND SUMMARY OF THE INVENTION

An object of the invention is to provide a more efficient marine propulsion method and system for submerged craft.

Another object of the invention is to provide more efficient underwater propulsion that virtually eliminates the wake drag effects produced by conventional systems being propelled through the water.

Another object of the invention is to provide a marine propulsion method and system using vortex flow to increase propulsion efficiency.

Another object of the invention is to provide a marine propulsion method and system enhanced concentric vortexes on a hull.

Another object of the invention is to provide a marine propulsion method and system powered internally in the hull to permit water-jet vectoring without the need for external control surfaces that otherwise create drag and reduce propulsion efficiency.

Another object of the invention is to provide a marine propulsion method and system having the ability to vector a craft by controlling internal water-jets and utilize more efficient exterior hull shapes.

Another object is to provide a marine propulsion method and system creating a virtually non-existent wake.

Another object of the invention is to provide a marine propulsion method and system using multiple jets of water that are pointed to flow coaxially and asymptotically along the surface of a hull of tapering elliptic, hyperbolic, or parabolic curvature (with K (p)>0, K (p)<0, and K (p)=0 (but S(p) ‡0), respectively) or similarly tapering curved hull that approaches a parallel flat plane (with K(p)=0, S(p)=0) at its end where the jets of water roll off the hull to induce efficient vortex wake effects, over the hull and past the hull, that optimize flow efficiency of a submerged craft being propelled through the water.

These and other objects of the invention will become more readily apparent from the ensuing specification when taken in conjunction with the appended claims.

Accordingly, the present invention is to an underwater propulsion system and method that are more efficient and reduce vortex wake effects. A submersible has a cylindrically-shaped hull, a nose portion connected forward and a tapering elliptic, hyperbolic, or parabolic curvature surface portion aft coaxially symmetrically disposed around a common longitudinally extending axis. The tapered portion has a leading end essentially the same diameter as the hull and a symmetrical apex at its trailing end on the longitudinal axis. The tapered portion has symmetrical rounded lateral contours laterally disposed from the longitudinal axis and rounded longitudinal contours extending from the leading end to the symmetrical apex. A high-volume pump inside of the leading end creates volumes of pressurized water from ambient water. Equal-distantly-spaced-apart jets in a circumferential row extending around the tapered portion extend through it and point in an asymptotical relationship with a down slope surface of the tapered portion. The jets emit jetted water from the volumes of pressurized water to form a spinning toroidal vortex of swirling jetted water on the down slope surface of the aft tapered portion.

DESCRIPTION OF THE PREFERRED EMBODIMENTS

Figure 1:
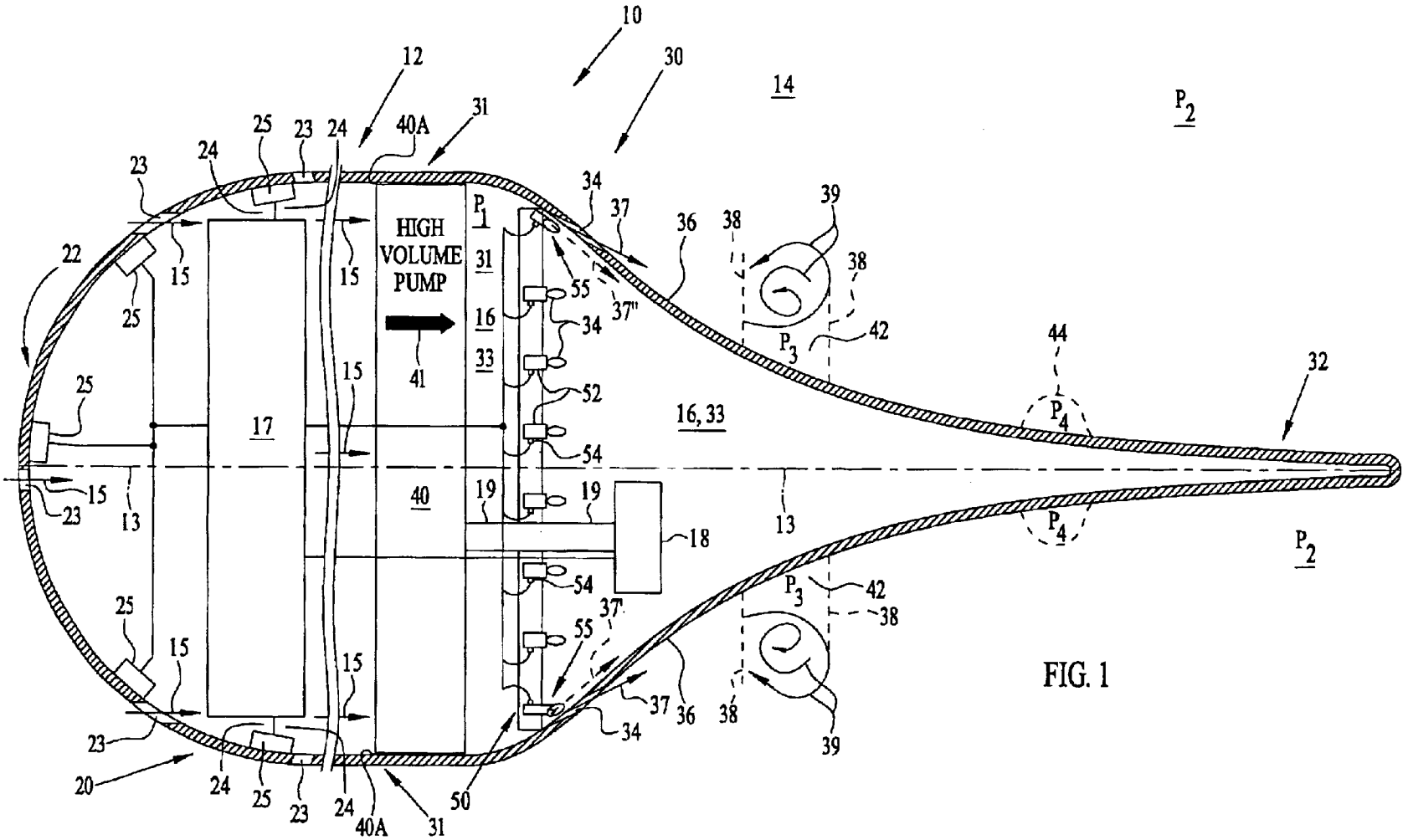
FIG. 1 is a schematic cross-sectional side view of one embodiment of the underwater propulsion system of the invention having a coaxially tapering elliptic, hyperbolic, or parabolic curvature surface portion aft on elongate submerged craft.
Figure 2:
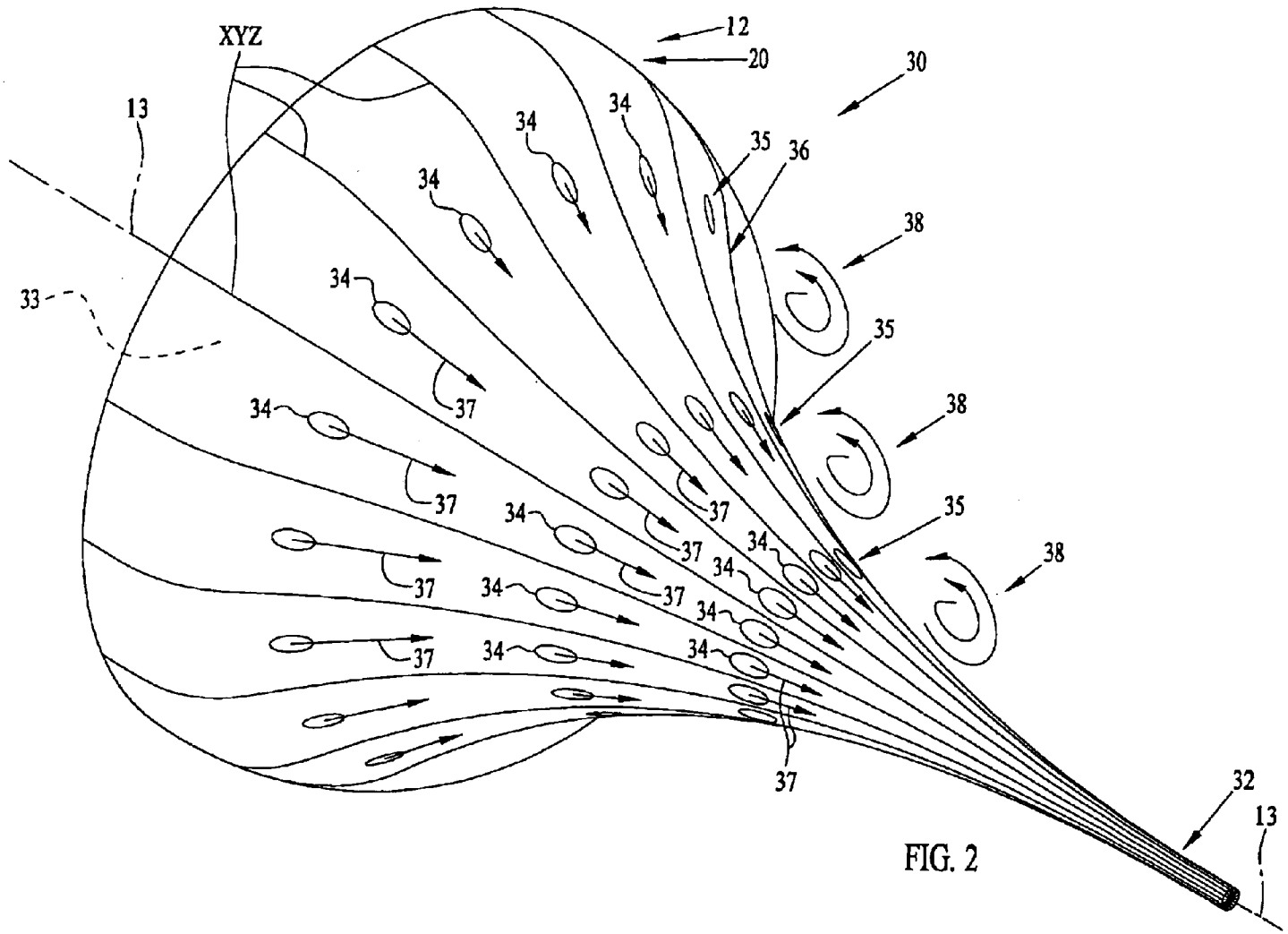
FIG. 2 is a schematic isometric view of the underwater propulsion system of the invention of FIG. 1 having rows of jets and showing XYZ lines on the tapered curvature surface portion to help visualization of its three-dimensional curvature.

Referring to FIGS. 1 and 2, an underwater propulsion system 10 of the invention transmits thrust for propulsion of an elongate submersible 12 through ambient water 14. Submersible 12 can be a torpedo-like undersea vehicle or any other autonomous or manned submerged craft that may be capable of traveling through water 14 at relatively high speeds. Submersible 12 has an outer cylindrically-shaped hull 20 having a rounded nose portion 22 forward and a shell-like tapered curvature surface portion 30 aft that are fabricated from strong and durable materials such as steel and other high-strength alloys or materials to provide protection and resist the effects of the harsh marine environment. A sealed modular section 17 in hull 20 has the necessary electronics and other instrumentation for guidance and control of submersible 12 as well as batteries or other fuel for an electric or other motor 18 and ordnance/sensors can be included for successful completion of a mission.

Cylindrically-shaped hull 20, rounded nose portion 22 and aft tapered curvature surface portion 30 are aligned on and coaxially symmetrically disposed around a common longitudinally extending axis 13. A leading end 31 of tapered aft curvature surface portion 30 is essentially the same diameter as cylindrically-shaped hull 20. Shell-like tapered aft curvature surface portion 30 has symmetrical rounded lateral contours laterally disposed from longitudinal axis 13 and rounded longitudinal contours extending from leading end 31 to a symmetrical apex 32 at its trailing end on longitudinal axis 13. See FIG. 2 where lines XYZ are schematically shown on tapered curvature surface portion 30 to help a reader visualize its three-dimensional curvature.

Inlet holes 23 can be provided around the circumference of nose portion 22 and/or as shown along hull 20. Holes 23 are in fluid communication with elongate inlet ducts 24 extending aft inside of hull 20 and outside of modular section 17 to a high-volume pump 40. From a practical point of view, inlet holes may be more likely to be located along hull 20 as shown instead of in nose portion 22.

High volume pump 40 can be a ducted turbine or propeller or impeller or positive displacement pump capable of drawing in water and expelling it at pressures greater than ambient water 14. High-volume pump 40 has a lip 40A sealed and secured to the inside of leading end 31 and with pump 40 extends across aft tapered portion 30, and pump 40 is connected to motor 18 via a shaft 19. Motor 18 can be located forward of pump 40 or aft in plenum chamber 33 in aft tapered portion 30 (as shown) to help cool motor 18 and place it away from sensors on submersible 12. Forceful rotation of pump (ducted turbine) 40 by motor 18 causes volumes (shown as arrows 15) of ambient water 14 to be drawn or pulled in through inlet holes 23 and channeled through inlet ducts 24 and pump 40 (shown as arrow 41) and into plenum chamber 33 in aft tapered portion 30. Water volumes 15 pumped by pump 40 into plenum chamber 33 create a volume 16 of pressurized water in plenum chamber 33 that has a pressure $P_1$ greater than the pressure $P_2$ of ambient water 14, ($P_1>P_2$).

Slide valves 25 on nose portion 22 and hull 20 are operatively coupled to modular section 17 for purposed of control. Slide valves 25 can be displaced to selectively expose, or cover and uncover inlet holes 23 to change or vary the flow, or flow rates of water volumes 15 that pump 40 pulls through inlet holes 23 and ducts 24. Being able to change the flow rate allows for multiple flow rates through ducts 24 and turbine 40 for different degrees of propulsion efficiency and/or propulsion noise.

The cross-sectional shape of shell-like aft tapered portion 30 can be substantially a coaxially tapering elliptic, hyperbolic, or parabolic curvature surface tapering along longitudinal axis 13 and converging to apex 32. The configuration of shell-like aft tapered section 30 can be the shell-like shape generated as the coaxially tapering elliptic, hyperbolic or parabolic curvature surface is rotated about longitudinal axis 13 with the part of the curvature surface at 90 degrees being at leading end 31 and the part of the curvature surface at 180 degrees being at apex 32. Tapered aft curvature surface portion 30 is most likely to be a coaxially tapering elliptic, hyperbolic, or parabolic curvature (with K (p)>0, K (p)<0, and K (p)=0 (but S(p) ‡0), respectively), or a similarly curved hull that approaches a parallel flat plane (with K(p)=0, S(p) =0) at its end, see pages 1–3 of the article "Gaussian Curvature," http://mathworld.wolfram.com//GaussianCurvature.html and definitions of Gaussian curvature K as a function of point p with a shape operator S. However, tapered aft curvature portion 30 can be formed as closely related rounded shapes that may not exactly conform to synolastic or anticlastic definitions of a curvature surface but be tapering shapes to perform substantially as described below.

Figure 3:
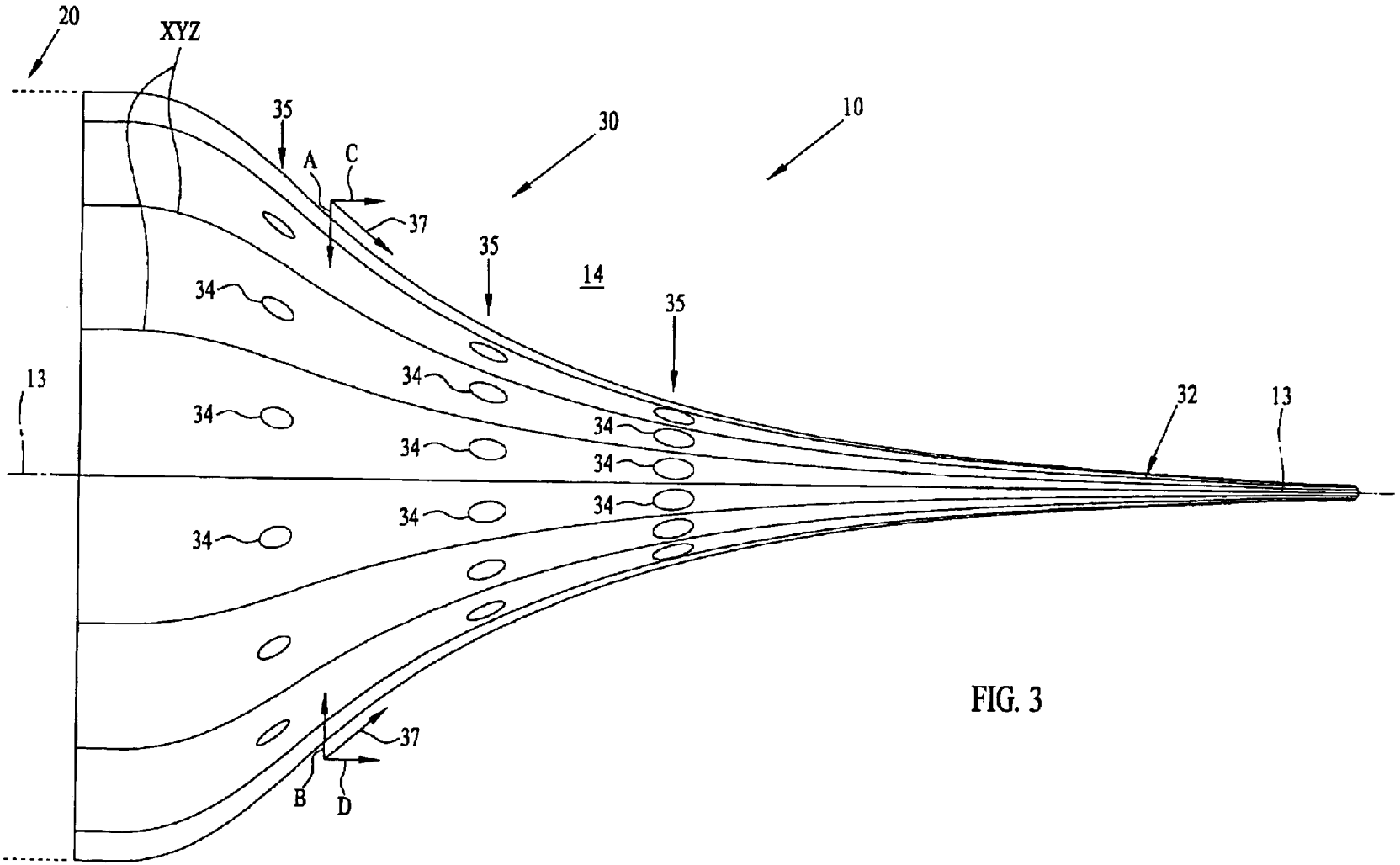
FIG. 3 is a schematic isometric view of another embodiment of the invention having an extended coaxially tapering elliptic, hyperbolic, or parabolic curvature surface aft portion.

The rate of the changing taper of curvature surface aft portion 30 (or longitudinal slope toward apex 32) can be made greater (steeper) or lesser (more gradual). FIG. 3 shows a more gradually sloping of curvature surface portion 30, and FIGS. 1 and 2 depict a steeper slope. Changing the curvature will affect the efficiency and/or reduce self-generated noise of submersible 12 as it is propelled through the water for given flow rates of water volumes 15. Generally, making the slope more gradual tends to induce more efficient vortex wake effects. The ratio of length to the diameter of tapered curvature surface portion 30 helps dissipate the converging toroidal vortex wake of submersible 12. Obviously, as the speed increases, submersible 12 moves forward and creates more turbulence. But, the advantages of a converging toroidal vortex wake remain, that is, increased thrust is produced by using tapering curvature surface portion 30 as a pressure point without any rudders or propellers, and the wake signature of submersible 12 is reduced by using the full length of tapered curvature surface portion 30 for reducing drag and enhancing efficiency.

A plurality of equal-distantly-spaced-apart jets 34 are bored through shell-like curvature surface portion 30 to hydraulically communicate with plenum chamber 33. The bored or otherwise shaped jets 34 are coaxially symmetrically disposed around longitudinally extending axis 13 and extend in a circumferentially extending ring-shaped row 35 around curvature surface portion 30. Each jet 34 has uniform cross section as it extends through shell-like curvature surface portion 30 and is angled to extend (point) outwardly in a virtually asymptotical relationship with respect to down slope surface 36 of curvature surface portion 30 located between row 35 of jets 34 and apex 32. Jets 34 are pointed asymptotically in three dimensions along curvature surface portion 30 to induce efficient vortex wake effects to optimize flow efficiency of submersible 12 as it is propelled through water 14.

Pressurized water 16 in plenum chamber 33 is forced, or jetted through jets 34 (shown by arrows 37) virtually at pressure $P_1$. Jetted water 37 coaxially and asymptotically follows the contours of three-dimensional sinusoidal-tapered aft portion 30 in accordance with the flow phenomena generally known as the Coanda Effect. The Coanda Effect was discovered in 1930 by a Romanian aerodynamicist Henri-Marie Coanda (1885–1972) who observed that a stream of air (or other fluid) emerging from a nozzle tends to follow a nearby curved surface, if the curvature of the surface or angle the surface makes with the stream is not too sharp, (i.e. does not induce flow separation); in other words, if a stream of water is flowing along a solid surface which is curved slightly from the stream, the water will tend to follow the surface. Surface tension of flowing water along tapered aft portion 30 may also tend to keep water following the surface.

Referring to FIG. 3, jetted water 37 down curvature surface portion 30 produces aft directed forces, shown as force-component vectors C and D that propel submersible 12 forward, and inwardly directed opposing forces shown as force-component vectors A and B over surface 36 that squeeze along tapered curvature surface 30. The inwardly directed forces of force-vector components A and B create additional forward propulsive forces or thrust for submersible 12. These additional forces are created by the same physics that cause a marble to pop outwardly and away when it is forcefully squeezed by converging forces along its sides.

Jetted water 37 from plenum chamber 33 through jets 34 contacts surrounding seawater 14 and the three-dimensional exterior curvature surface portion 30 of down slope 36 to propel submersible 12 forward. The drag created by jetted water 37 from all jets 34 flowing asymptotically down curvature surface portion 30 causes the flowing jetted water 37 to swirl in a spinning ring or toroidal-shaped vortex 38. Swirling jetted water (shown as arrows 39) of toroidal vortex ring 38 spins in the direction of curved arrows 39 and travels inward toward and rearward along longitudinal axis 13 of submersible 12, and vortex ring 38 partially collapses inward on itself as it travels down slope 36. When vortex ring 38 goes beyond and separates from apex 33, it substantially completely collapses in on itself effectively canceling itself out as a converging wake. The creation of whirling toroidal vortex 38, its transition along down slope 36, and its substantially complete, self-canceling collapse as a converging wake occurs at and beyond apex 33 as an ongoing process during transit of submersible 12.

One of the effects of spinning toroidal vortex 38 as it spins inward against down slope 36 of tapering curvature surface portion 30 is that it acts to successively further push submersible 12 forward by the use of converging toroidal vortex turbulence. This is because the converging spinning toroidal vortex 38 creates a roughly defined band 42 of pressure at pressure $P_3$ around tapering curvature surface portion 30 on down slope 36 that is less than $P_1$ but greater than $P_2$, ($P_1>P_3>P_2$). Consequently, spinning toroidal vortex 38 acts to push submersible 12 forward. An additional effect is that the inward collapsing convergence of vortex ring 38 successively squeezes down against tapering curvature surface portion 30 in three dimensions to produce still more forward propulsive forces on tapering curvature surface portion 30 to further add to propulsion efficiency. In this latter instance, a roughly defined band 44 of pressure at pressure $P_4$ is created around tapering curvature surface portion 30 near and at apex 33 that is less than $P_3$, ($P_3>P_4$) and approaching the pressure $P_2$ of ambient water 14 so that more propulsive force is produced by spinning toroidal vortex 38. These hydrodynamic effects can act to artificially increase the apparent length of tapered curvature surface portion 30 of hull 20 since the rapidly spinning toroidal vortex 38 of underwater propulsion system 10 directs more flowing jetted water 37 on tapered curvature surface portion 30 than would be on it if this portion were merely passing through static ambient water 14. Thus, the whirling fluid of vortex 38 can push tapered curvature surface portion 30 through the water with reduced drag effects, turbulence, and wake to more efficiently propel submersible 12 through water 14. The swirling jetted water 39 of vortex 38 can have its toroidal shape changed and become elongated, that is a have an elliptical or somewhat flattened cross-sectional "toroidal" shape during transit of submersible 12.

If jets 34 directed jetted water 37 aft and more outwardly from aft tapered portion 30, each toroidal vortex 38 may swirl in the opposite direction. However, each oppositely swirling toroidal vortex can create thrust, additive force and self-canceling effects as described elsewhere herein.

Underwater propulsion system 10 of the invention can steer and maneuver submersible 12 without any external control surfaces on cylindrical hull 20, nose portion 22 or tapered curvature surface portion 30. A selectively activated control assembly 50 can be mounted on the inside of tapered curvature surface portion 30. Control assembly can include displaceable shutter elements 52 connected to displacers 54, such as appropriately connected electric motors or solenoids connected to and controlled from appropriate parts of modular section 17. Selective ones or combinations of shutter elements 52 are displaced by interconnected displacers 54 to restrict, or reduce the flow, or amount of jetted water 37 emitted by some jets 34 to reduce the propulsive forces created by the restricted jets 34. The reduced propulsive forces 37 directed through some jets 34 create an imbalance with respect to the propulsive forces produced by other jetted water 37 from other jets 34 that are not so restricted. The resultant unevenness of propulsive forces (or forces represented by either one of force vectors A or B, for example) can be used to steer and maneuver submersible 12 since the other force vector A or B has no counterpart. Consequently, the aft end of submersible 12 is pushed to one side or the other by force attributed to the force vector that is not countered. Selective actuation of jetted water 37 through jets 34 allows not only simple steering to left and right but complex turning, banking, pitching, rolling, and heaving maneuvers can be implemented as desired. This advantageous control capability in underwater propulsion system 10 does not add anything that might protrudes into the hydrodynamic flow to create drag and noise.

Control assemble 50 can include displaceable nozzles 55 connected to displacers 54 instead of some or all of shutter elements 52 (only two displaceable nozzles 55 are schematically shown in FIG. 1, it being understood that more or all shutters 52 adjacent jets 34 could be displaceable nozzles 55). Displaceable nozzles 55 can emit jetted water 37' through an adjacent jet 34 (as shown by a lower one of nozzles 55) or can communicate with ambient water 14 directly to emit jetted water 37" directly outside of submersible 12 (as shown by an upper one of nozzles 55). Activation of displacers 54 might also change the flow characteristics of selective ones of displaceable nozzles 55. In other words, displaceable nozzles 55 can have a capability to displace, or vary their geometry and be activated by displacers 54 to converge or diverge jetted water 37', 37" and consequently change their propulsive force (thrust). Displaceable nozzles 55 could also be mounted and connected to displacers 54 to selectively redirect, or aim their flows of jetted water 37 (and resultant propulsive thrust) to steer and maneuver submersible 12 without adding appreciable drag and noise.

Referring to FIG. 2 where XYZ lines help visualize curvature of tapered curvature surface portion 30, multiple rows 35 of jets 34 in tapered curvature surface portion 30 are each coaxially symmetrically disposed around longitudinally extending axis 13. Plenum chamber 33 is hydraulically coupled to jets 34 that emit jetted water 37 that creates spinning toroidal vortexes 38 of swirling jetted water 39 along tapered curvature portion 30 that produce hydrodynamic effects as described above. Jets 34 in some rows 35 can be differently dimensioned and/or have control assemblies 50 with shutter elements 52 and/or displaceable nozzles 55. Since more hydrodynamic activity is being produced, higher efficiency for propulsion and/or wake-reduction results.

Underwater propulsion system 10 maximizes propulsion efficiency and makes use of flows of one or more vortexes 38 to increase propulsion efficiency. Power for jets 34 is internal to hull 20 and portion 30, to permit vectoring of jetted water by changing the flow from selected jets 34 and/or displacing nozzles 55. This vectoring can steer and maneuver submersible 12 without creating efficiency-robbing drag and excessive wake-turbulence associated with external control surfaces. Underwater propulsion system 10 creates jetted water 37 pointed asymptotically along a hull of a tapering elliptic, hyperbolic, or parabolic curvature (or similarly curved) aft portion 30 to induce vortex wake effects that optimize flow efficiency of submersible 12 to approaches a parallel flat plane as goes through ambient water 14. Underwater propulsion system 10 provides more efficient underwater propulsion that virtually eliminates the wake drag effects produced as conventional craft are propelled through the water.

Figure 4:
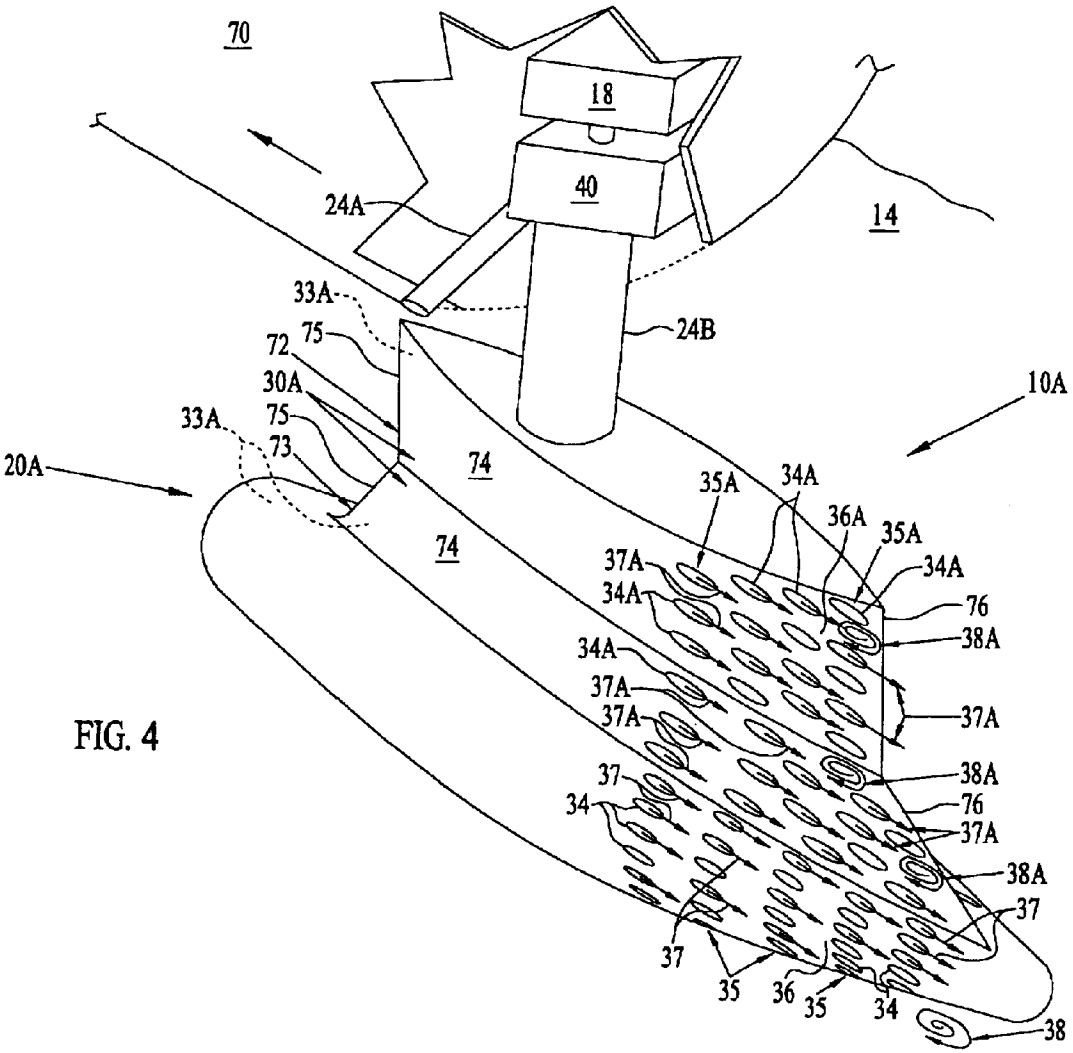
FIG. 4 is a schematic view of another embodiment of the underwater propulsion system of the invention to propel and steer a surface ship.

Referring to FIG. 4, a surface ship 70 can reduce noise and increase efficiency of propulsion by using a modified form of underwater propulsion system 10 that is connected to ship 70 by an elongate outlet duct 24B and elongate vertically extending strut 72 having a tapered fairing 73. Duct 24B and strut 72 are robustly made and interconnected to ship 70 to transmit the propulsive and steering forces generated by modified propulsion system 10A to ship 70. Strut 72 and fairing 73 can have vertically extending lateral surfaces 74 on opposite sides that are joined together at their leading and trailing edges 75, 76 to form curvature surface portions 30A having streamlined cross-sectional shapes. Optionally, curvature surface portions 30A of lateral surfaces 74 can have converging elliptic, hyperbolic, or parabolic shapes similar to the cross-sectional shape of hull 20 described above; however, curvature surface portions 30A of lateral surfaces 74 vertically extend with respect to each other between leading and trailing edges 75, 76.

Motor 18 and pump 40 and other constituents of propulsion system 10 can be retained in hull 20A and operate as described above in modified system propulsion 10A. Optionally, as shown in FIG. 4, motor 18 and pump 40 can be relocated in modified system 10A inside of ship 70 and at least one inlet duct 24A can be used to draw in ambient water 14 for motor driven pump 40, and at least one outlet duct 24B can be connected to channel the drawn in water via strut 72 and fairing 73 into a plenum chamber 33A in hull 20A.

Plenum chamber 33A functions essentially the same as plenum chamber 33 described above, and since strut 72 and fairing 73 are hollow, the insides of strut 72 and fairing 73 can hydraulically communicate with plenum chamber 33A, or be considered as extensions of plenum chamber 33A inside of hull 20A. This configuration permits jetted pressurized water 37A to be forced through rows 35A of spaced apart jets 34A that point aft on strut 72 and fairing 73 to add forward propulsive thrust and steering capability for ship 70. Underwater propulsion system 10A in hull 20A can operate as described above with respect to rows 35 of jets 34 plus the thrust and steering capabilities of rows 35A of jets 34A can be added. In addition, strut 72 and fairing 73 can be selectively rotated to steer ship 70 with jetted pressurized water 37, 37A from rows 34, 34A and/or by selectively vented pressurized water 37, 37A. Pressurized water 37A jetted from plenum chamber 33A and strut 72 and fairing 73 through said jets 34A in strut 72 and fairing 73 and pressurized water 37 jetted through jets 34 in aft tapered curvature surface portion 30 contacts ambient water and down slope 36A of strut 72 and fairing 73 and down slope 36 of aft tapered curvature surface portion 30 to propel ship 70 forward. The drag created by water jetted from jets 34A flows asymptotically along down slope 36A toward the rear of strut 72 and fairing 73 and creates spinning toroidal vortexes 38A (only one of which is shown on each of strut 72 and on fairing 73) of swirling jetted water that travels inward toward and rearward along strut 72 and fairing 73. This drag on strut 72 and fairing 73 is in addition to the drag created by vortexes 38 (only one of which is shown) along aft tapered curvature surface 30 as described above. Spinning toroidal vortexes 38A, 38 of swirling jetted water partially collapse inward as they travel along down slope 36A of strut 72 and fairing 73 and down slope 36 of aft tapered curvature surface portion 30, respectively where collapse of vortexes 38A, 38 is completed to cancel a converging wake. Creation of whirling toroidal vortexes 38A, 38; transition of toroidal vortexes 38A, 38, rearward along down slope 36A and down slope 36; and substantial, self-canceling collapse of whirling toroidal vortexes 38A, 38 as a converging wake are an ongoing process during transit of ship 70.

Having the teachings of this invention in mind, modifications and alternate embodiments of underwater propulsion system 10 may be adapted without departing from the scope of the invention. Underwater propulsion system 10 can be adapted to other hull designs than cylindrically-shaped hull 20 disclosed herein. Tapered curvature portion 30 can be made to fit differently shaped and differently dimensioned undersea craft and fabricated from a wide variety of suitable materials to assure resistance to corrosion and sufficient strength for long-term reliable operation under a multitude of different operational requirements. Its uncomplicated, compact design incorporates structures and technologies long proven to operate successfully underwater. Therefore, underwater propulsion system 10 of the invention is fully capable of high-speed operation with vortex-wake formation virtually eliminated, or reduced to acceptable levels while preserving efficiency by using the converging spinning toroidal vortex of propulsion as a propulsive force throughout the tapering curvature surface.

The disclosed components and their arrangements as disclosed herein, all contribute to the novel features of this invention. Underwater propulsion system 10 assures reliable faster transit with less, or no vortex wake to reduced chances of being detected to assure successful completion of a mission. Therefore, underwater propulsion system 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. An underwater propulsion system:

a submersible having a cylindrically-shaped hull and a nose portion connected forward on said hull;

a tapered portion having a coaxially tapered curvature surface mounted aft on said hull, said hull, nose portion and aft tapered curvature surface portion being coaxially symmetrically disposed around a common longitudinally extending axis, said coaxially disposed aft tapered curvature surface portion having a leading end essentially the same diameter as said hull and a symmetrical apex at its trailing end on said longitudinal axis, and said aft tapered curvature surface portion having symmetrical rounded lateral contours laterally disposed from said longitudinal axis and rounded longitudinal contours extending from said leading end to said symmetrical apex;

a high-volume pump sealed and secured to the inside of said leading end to extend across said aft tapered curvature portion to create volumes of pressurized water from ambient water; and a plurality of equal-distantly-spaced-apart jets extending through said aft tapered curvature surface portion and being arranged in a circumferentially extending row around said aft tapered curvature surface portion, each of said jets being angled to point outwardly from said aft tapered curvature surface portion, and emitting jetted water from said volumes of pressurized water to form a spinning toroidal vortex of swirling jetted water on a down slope surface of said aft tapered curvature surface portion.

2. The system of claim 1 wherein each of said jets are angled to point outwardly in a virtually asymptotical relationship with said down slope surface of said aft tapered curvature surface portion.

3. The system of claim 2 wherein said jets are pointed asymptotically in three dimensions along said down slope surface of said aft tapered curvature surface portion.

4. The system of claim 3 wherein said aft tapered curvature surface portion has a coaxially extending elliptic curvature surface.

5. The system of claim 3 wherein said aft tapered curvature surface portion has a coaxially extending hyperbolic curvature surface.

6. The system of claim 3 wherein said aft tapered curvature surface portion has a coaxially extending parabolic curvature surface.

7. The system of claim 3 further comprising:

a plenum chamber adjacent said pump and inside of said aft tapered curvature surface portion to receive said pressurized water therein, each of said jets hydraulically communicating with said plenum chamber.

8. The system of claim 7 further comprising:

circumferentially disposed inlet holes on at least one of said nose portion and said hull, said inlet holes being in fluid communication with elongate inlet ducts extending aft inside of said hull to channel some ambient water to said pump.

9. The system of claim 8 further comprising:

displaceable slide valves on said nose portion to selectively expose said inlet holes and change flow rates of water volumes of said ambient water drawn in by said pump for said plenum chamber.

10. The system of claim 9 further comprising:

a selectively activated control assembly mounted on the inside of said aft tapered curvature surface portion.

11. The system of claim 10 wherein said control assembly includes displaceable shutter elements connected to displacers.

12. The system of claim 11 wherein said control assembly can be selectively actuated to displace said shutter elements by interconnected said displacers to reduce amounts of water emitted by some of said jets and propulsive forces created thereby.

13. The system of claim 12 wherein said reduced propulsive forces created by some of said jets creates an imbalance with respect to propulsive forces produced by other water jetted from other of said jets to steer said submersible.

14. The system of claim 10 wherein said control assembly includes displaceable nozzles connected to displacers.

15. The system of claim 14 wherein said displacers change flow characteristics of selective ones of said displaceable nozzles to steer said submersible.

16. The system of claim 15 wherein said displaceable nozzles vary their geometry by said displacers to selectively converge and diverge water jetted through them to change their propulsive force and steer said submersible.

17. The system of claim 9 further comprising:

a plurality of rows of said jets in said aft tapered curvature surface portion, all of said plurality being hydraulically coupled to said plenum chamber to emit jetted water and create said spinning toroidal vortex of said swirling jetted water.

18. The system of claim 7 wherein water jetted from said plenum chamber contacts said ambient water and said down slope of said aft tapered curvature surface portion to propel said submersible forward.

19. The system of claim 18 wherein drag created by water jetted from said jets and flowing asymptotically down said aft tapered curvature surface portion creates said spinning toroidal vortex of said swirling jetted water that travels inward toward and rearward along said longitudinal axis.

20. The system of claim 19 wherein said spinning toroidal vortex of said swirling jetted water partially collapses inward on itself as it travels along said down slope of said aft tapered curvature surface portion and past said apex where collapse is completed to cancel a converging wake.

21. The system of claim 20 wherein creation of said whirling toroidal vortex, transition of said whirling toroidal vortex along said down slope, and substantial, self-canceling collapse of said whirling toroidal vortex as a converging wake are an ongoing process during transit of said submersible.

22. The system of claim 21 wherein said aft tapered curvature surface portion has a coaxially extending elliptic curvature surface.

23. The system of claim 21 wherein said aft tapered curvature surface portion has a coaxially extending hyperbolic curvature surface.

24. The system of claim 21 wherein said aft tapered curvature surface portion has a coaxially extending parabolic curvature surface.

25. A method of propelling a submersible comprising the steps of:

aligning a cylindrically-shaped hull, a forward nose portion, and an aft coaxially tapered curvature surface portion on a longitudinally extending axis;

shaping said aft tapered curvature surface portion to have symmetrical rounded lateral contours laterally disposed from said longitudinal axis and rounded longitudinal contours extending from a leading end to a symmetrical apex at its trailing end;

mounting said leading end of said aft tapered curvature surface portion on said hull to locate said symmetrical apex at its trailing end on said longitudinally extending axis;

creating volumes of pressurized water inside of said aft tapered curvature surface portion with a high-volume pump inside of said leading end;

arranging a plurality of equal-distantly-spaced-apart jets extending through said aft tapered curvature surface portion in a circumferentially extending row around said aft tapered curvature surface portion;

angling each of said jets to point outwardly from said aft tapered curvature surface portion; and jetting water from said volumes of pressurized water through said jets to form a spinning toroidal vortex of swirling jetted water on a down slope surface of said aft tapered curvature surface portion.

26. The method of claim 25 further comprising the step of:

angling said jets to point outwardly in a virtually asymptotical relationship with respect to said down slope surface of said aft tapered curvature surface portion.

27. The method of claim 26 wherein said step of angling includes the step of pointing said jets asymptotically in three dimensions along said down slope surface of said aft tapered curvature surface portion.

28. The method of claim 27 further including the steps of:

receiving said pressurized water in a plenum chamber adjacent said pump and inside of said aft tapered portion; and hydraulically communicating each of said jets with said plenum chamber.

29. The method of claim 28 further comprising the step of:

channeling some ambient water to said pump through circumferentially disposed inlet holes on at least one of said nose portion and said hull, said inlet holes being in fluid communication with elongate inlet ducts extending aft inside of said hull.

30. The method of claim 29 further comprising the steps of:

displacing slide valves on said nose portion to selectively expose said inlet holes; and changing flow rates of water volumes of said ambient water drawn in by said pump for said plenum chamber.

31. The method of claim 30 further including the step of:

mounting a selectively activated control assembly on the inside of said aft tapered curvature surface portion.

32. The method of claim 31 further comprising the step of:

including displaceable shutter elements connected to displacers in said control assembly, said control assembly being selectively actuated to displace said shutter elements by interconnected displacers to reduce amounts of water emitted by some of said jets and propulsive forces created thereby.

33. The method of claim 32 further comprising the step of:

creating an imbalance with said reduced propulsive force with respect to propulsive forces produced by other water jetted from other of said jets to steer and maneuver said submersible.

34. The method of claim 33 further including the step of:

including displaceable nozzles connected to displacers in said control assembly.

35. The method of claim 34 further comprising the steps of:

changing flow characteristics of selective ones of said displaceable nozzles by said displacers to emit water to said ambient water and steer said submersible; and varying the geometry of said displaceable nozzles by said displacers to selectively converge and diverge water jetted through them to change their propulsive force and steer said submersible.

36. The method of claim 30 further comprising the steps of:

hydraulically coupling a plurality of rows of said jets in said aft tapered curvature surface portion to said plenum chamber; and emitting jetted water to create said spinning toroidal vortex of said swirling jetted water.

37. The method of claim 30 further comprising the step of:

propelling said submersible forward as water jetted from said plenum chamber contacts said ambient water and said down slope of said aft tapered curvature surface portion.

38. The method of claim 25 further comprising the step of:

creating said spinning toroidal vortex of said swirling jetted water traveling inward toward and rearward along said longitudinal axis by drag created by water jetted from said jets and flowing asymptotically along said aft tapered curvature surface portion.

39. A combination underwater propulsion system and ship to reduce noise and increase efficiency of propulsion comprising:

a ship having a motor driven pump connected to a hollow strut at its aft end, said pump being a high-volume pump to create volumes of pressurized water from ambient water;

an underwater propulsion system having a cylindrically-shaped hull having a nose portion and being connected to said strut;

a tapered portion having a coaxially tapered curvature surface mounted aft on said hull, said hull, rounded nose portion and aft tapered curvature surface portion being coaxially symmetrically disposed around a common longitudinally extending axis, said coaxially disposed aft tapered curvature surface portion having a leading end essentially the same diameter as said hull and a symmetrical apex at its trailing end on said longitudinal axis, and said aft tapered curvature surface portion having symmetrical rounded lateral contours laterally disposed from said longitudinal axis and rounded longitudinal contours extending from said leading end to said symmetrical apex; and a plurality of equal-distantly-spaced-apart jets extending through said aft tapered curvature surface portion and being arranged in a circumferentially extending row around said aft tapered curvature surface portion, each of said jets being angled to point outwardly from said aft tapered curvature surface portion, and emitting jetted water from said volumes of pressurized water to form a spinning toroidal vortex of swirling jetted water on a down slope surface of said aft tapered curvature surface portion.

40. The combination of claim 39 wherein said pump has at least one inlet duct to draw in ambient water and at least one outlet duct to channel said drawn in water to said strut, and each of said jets are angled to point outwardly in a virtually asymptotical relationship with said down slope surface of said aft tapered curvature surface portion.

41. The combination of claim 40 wherein said strut has a fairing and said strut and fairing are hollow and have jets pointed to the rear of said strut and fairing, and jets of said strut and fairing are pointed asymptotically in three dimensions along a down slope portion of said strut and fairing.

42. The combination of claim 41 wherein said aft tapered curvature surface portion has a coaxially extending elliptic curvature surface.

43. The combination of claim 41 wherein said aft tapered curvature surface portion has a coaxially extending hyperbolic curvature surface.

44. The combination of claim 41 wherein said aft tapered curvature surface portion has a coaxially extending parabolic curvature surface.

45. The combination of claim 41 further comprising:

a plenum chamber inside of said aft tapered curvature surface portion and said strut and said fairing to receive said pressurized water therein, each of said jets in said strut, fairing, and aft tapered curvature surface portion hydraulically communicating with said plenum chamber.

46. The combination of claim 45 wherein said strut and fairing can be selectively rotated to steer said ship with jetted pressurized water from said strut and said underwater propulsion system.

47. The combination of claim 46 wherein said strut and fairing can be selectively vented by pressurized water to steer said ship.

48. The combination of claim 47 further comprising:

a plurality of rows of said jets in said strut, said fairing, and said aft tapered curvature surface portion, all of said plurality of rows being hydraulically coupled to said plenum chamber to emit jetted water and create spinning toroidal vortexes of swirling jetted water over said strut, said fairing, and said aft tapered curvature surface.

49. The combination of claim 48 wherein water jetted from said plenum chamber through said jets in said strut, said fairing, and said aft tapered curvature surface portion contacts said ambient water and said down slope of said aft tapered curvature surface portion to propel said submersible forward.

50. The combination of claim 49 wherein drag created by water jetted from said jets and flowing asymptotically down said strut, said fairing, and said aft tapered curvature surface portion creates spinning toroidal vortexes of swirling jetted water that travel inward toward and rearward along said longitudinal axis.

51. The combination of claim 50 wherein said spinning toroidal vortexes of swirling jetted water partially collapses inward during travel along said strut, said fairing, and said down slope of said aft tapered curvature surface portion and past said apex where collapse is completed to cancel a converging wake.

52. The system of claim 51 wherein creation of said whirling toroidal vortexes, transition of said whirling toroidal vortexes along said strut, said fairing, and said down slope, and substantial, self-canceling collapse of said whirling toroidal vortexes as a converging wake are an ongoing process during transit of said submersible.

* * * * *